US005864289A

United States Patent [19]

Tiemann

[11] Patent Number: 5,864,289

[45] Date of Patent: Jan. 26, 1999

[54] COIN CARRIER

[76] Inventor: Kimberly D. Tiemann, 723 ½ W. Adams St., Belleville, Ill. 62220

[21] Appl. No.: 79,736

[22] Filed: May 15, 1998

[51] Int. Cl.[6] ..... G08B 13/14

[52] U.S. Cl. ..... 340/568.7; 340/571; 340/686; 340/692; 340/693.5; 224/236; 224/610

[58] Field of Search ..... 340/568.7, 571, 340/686, 692, 693.5; 224/235, 236 R, 610 R, 148.5

[56] References Cited

U.S. PATENT DOCUMENTS

| | | | |
|---|---|---|---|
| 4,620,555 | 11/1986 | Schwarz | 131/270 |
| 4,972,557 | 11/1990 | Williams | 224/163 |
| 4,974,761 | 12/1990 | Luque | 224/148.5 |
| 5,172,097 | 12/1992 | Arnold | 340/543 |
| 5,240,158 | 8/1993 | Walsh | 224/226 |
| 5,407,110 | 4/1995 | Marsh, Jr. | 224/148 |
| 5,431,319 | 7/1995 | Cavadini et al. | 224/258 |
| 5,454,497 | 10/1995 | Kettleson | 224/148 |
| 5,505,353 | 4/1996 | Marsh, Jr. | 224/148 |
| 5,622,346 | 4/1997 | Story, Jr. | 248/311.2 |

*Primary Examiner*—Daniel J. Wu
*Attorney, Agent, or Firm*—Joseph N. Breaux

[57] ABSTRACT

A coin carrier that includes a cup holder member, a lid member including an audible open lid altering mechanism, and an adjustable length support strap assembly. The cup holder member includes a central coin cup receiving cavity that is accessible through a top receiving cavity opening, and a logo display area, a lid securing hook and pile fastener section, and at least one closable side pocket carried on an exterior sidewall thereof. The lid member is pivotally attached to the cup holder member with a flexible hinge strap. The lid member includes a securing tab that is securable to the lid securing hook and pile fastener section of the cup holder member. The audible open lid alerting mechanism includes an on/off switch, a battery connector, an activation switch, an audible signal generating circuit, and a speaker. The activation switch is positioned on a receiving cavity facing surface of the lid member at a location such that, when the lid member is positioned over and sealing the top receiving cavity opening, the activation switch is depressed sufficiently to reset the audible signal generating circuit, the audible open lid alerting mechanism being activated by opening the lid member.

2 Claims, 2 Drawing Sheets

COIN CARRIER

TECHNICAL FIELD

The present invention relates to devices and methods for carrying and storing personal items and more particularly to a coin carrier including cup holder member, a lid member including an audible open lid alerting mechanism, and an adjustable length support strap assembly; the cup holder member including a central coin cup receiving cavity formed into the center thereof that is accessible through a top receiving cavity opening, and a logo display area, a lid securing hook and pile fastener section, and at least one closable side pocket carried on an exterior sidewall thereof; the lid member being pivotally attached to the cup holder member with a flexible hinge strap in a manner to be securable over the top receiving cavity opening of the cup holder member; the lid member including a securing tab that is securable to the lid securing hook and pile fastener section of the cup holder member; the audible open lid alerting mechanism including an on/off switch, a battery connector, an activation switch, an audible signal generating circuit, and a speaker; the activation switch being positioned on a receiving cavity facing surface of the lid member at a location such that, when the lid member is positioned over and sealing the top receiving cavity opening, the activation switch is depressed sufficiently to reset the audible signal generating circuit; the adjustable length support strap assembly including left and right support straps each having an end secured to the exterior sidewall of the cup holder member and an adjustment buckle securing the left and right support straps into a closed loop.

BACKGROUND ART

It can often be necessary when gambling in a casino or the like to carry a large number of coins in a plastic holding cup. Although the plastic holding cup can hold a number of coins, because of the large diameter of such cups, it can be difficult for persons with small hands or persons with arthritis to grip and hold such coin laden cups comfortably. It would be a benefit, therefore, to have a coin carrier that could be used to carry coins or a coin holding cup that included a neck/shoulder support strap that allowed that coins to be carried without the necessity of gripping and holding with the hands. In addition, because the coins are easily accessed through the open top of a coin carrying cup and are therefore subject to pilfering, it would be a further benefit to have a coin carrier that included a lid that was securable over the access opening. It would of course be a further benefit to have a coin carrier including a lid having an audible alerting mechanism that generated an audible output each time the lid was opened.

GENERAL SUMMARY DISCUSSION OF INVENTION

It is thus an object of the invention to provide a coin carrier that a neck/shoulder support strap that allows a large number of coins to be carried without the necessity of gripping and holding a coin carrying container such as a coin cup with the hands.

It is a further object of the invention to provide a coin carrier that has a lid member.

It is a still further object of the invention to provide a coin carrier that includes a lid having an audible alerting mechanism that generates an audible output each time the lid is opened.

It is a still further object of the invention to provide a coin carrier that includes a cup holder member, a lid member including an audible open lid alerting mechanism, and an adjustable length support strap assembly; the cup holder member including a central coin cup receiving cavity formed into the center thereof that is accessible through a top receiving cavity opening, and a logo display area, a lid securing hook and pile fastener section, and at least one closable side pocket carried on an exterior sidewall thereof; the lid member being pivotally attached to the cup holder member with a flexible hinge strap in a manner to be securable over the top receiving cavity opening of the cup holder member; the lid member including a securing tab that is securable to the lid securing hook and pile fastener section of the cup holder member; the audible open lid alerting mechanism including an on/off switch, a battery connector, an activation switch, an audible signal generating circuit, and a speaker; the activation switch being positioned on a receiving cavity facing surface of the lid member at a location such that, when the lid member is positioned over and sealing the top receiving cavity opening, the activation switch is depressed sufficiently to reset the audible signal generating circuit; the adjustable length support strap assembly including left and right support straps each having an end secured to the exterior sidewall of the cup holder member and an adjustment buckle securing the left and right support straps into a closed loop.

It is a still further object to provide a coin carrier that accomplishes one or more of the above objects in combination.

Accordingly, a coin carrier is provided. The coin carrier includes a cup holder member, a lid member including an audible open lid alerting mechanism, and an adjustable length support strap assembly; the cup holder member including a central coin cup receiving cavity formed into the center thereof that is accessible through a top receiving cavity opening, and a logo display area, a lid securing hook and pile fastener section, and at least one closable side pocket carried on an exterior sidewall thereof; the lid member being pivotally attached to the cup holder member with a flexible hinge strap in a manner to be securable over the top receiving cavity opening of the cup holder member; the lid member including a securing tap that is securable to the lid securing hook and pile fastener section of the cup holder member; the audible open lid alerting mechanism including an on/off switch, a battery connector, an activation switch, an audible signal generating circuit, and a speaker; the activation switch being positioned on a receiving cavity facing surface of the lid member at a location such that, when the lid member is positioned over and sealing the top receiving cavity opening, the activation switch is depressed sufficiently to reset the audible signal generating circuit; the adjustable length support strap assembly including left and right support straps each having an end secured to the exterior sidewall of the cup holder member and an adjustment buckle securing the left and right support straps into a closed loop.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
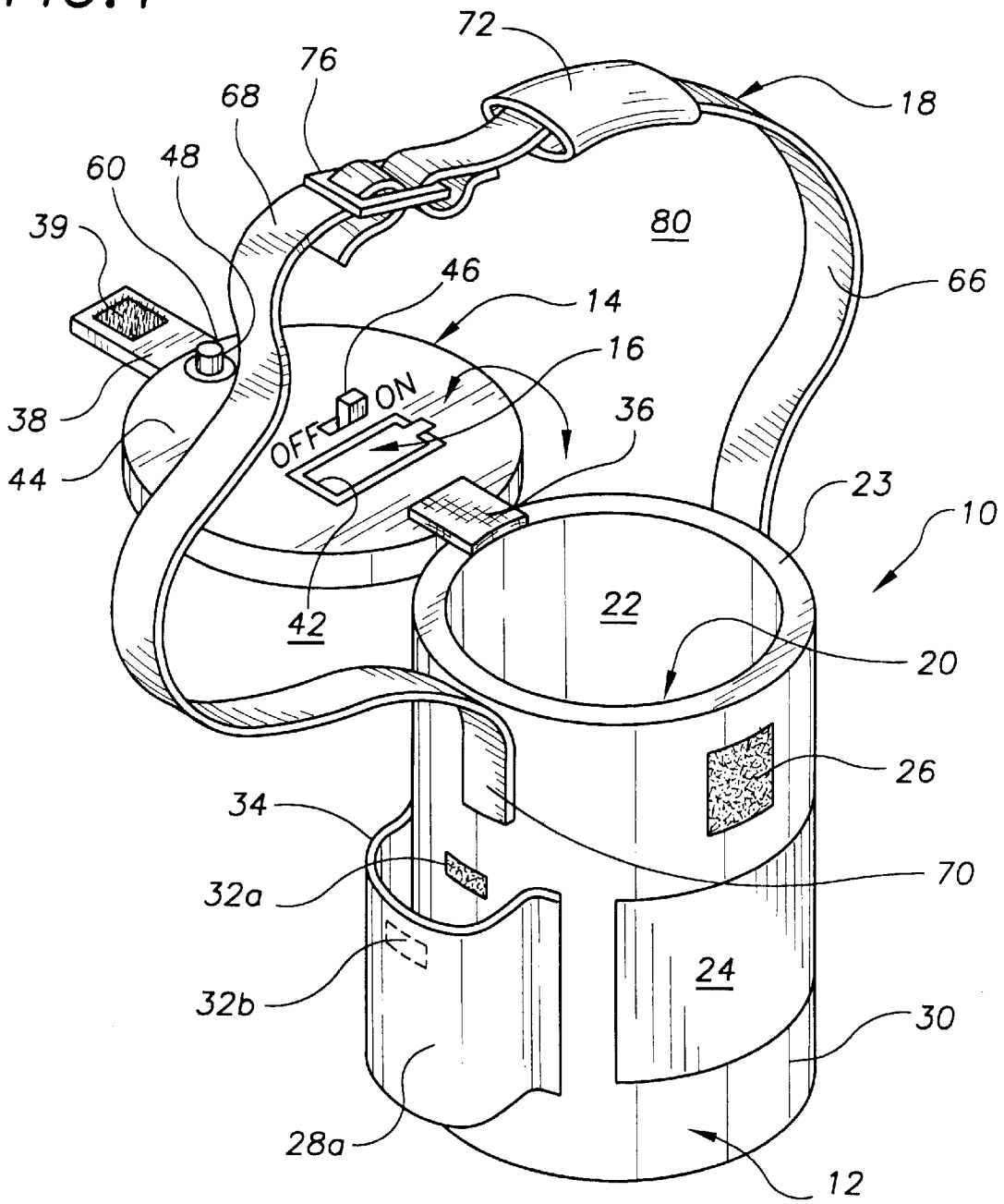
FIG. 1 is a perspective view of an exemplary embodiment of the coin carrier of the present invention showing the cup holder member including the central coin cup receiving cavity formed into the center of the cup holder member, and the logo display area, the lid securing hook and pile fastener section, and one of the two closable side pockets formed on the exterior of the cup holder member; the lid member pivotally attached to the cup holder member in a manner to be securable over the opening to the coin cup receiving cavity of the cup holder member, the securing tab securable to the lid securing hook and pile fastener section of the cup holder member, and the audible open lid alerting mechanism including the on/off switch and the activation switch; and the adjustable length support strap assembly including the left and right support straps each having an end secured to the exterior sidewall of the cup holder member, the adjustment buckle securing the left and right support straps into a closed loop and the shoulder/neck cushion slidable positioned onto the left support strap.

FIG. 1 shows an exemplary embodiment of the coin carrier of the present invention generally designated by the numeral 10. Coin carrier 10 includes a cup holder member, generally designated 12; a lid member, generally designated 14, including an audible open lid alerting mechanism, generally designated 16; and an adjustable length support strap assembly, generally designated 18.

Cup holder member 12 is plastic, is molded into a cup shaped configuration and includes a cylindrical shaped central coin cup receiving cavity 20 formed into a center thereof that is accessible through a circular top receiving cavity opening 22. Top receiving cavity opening 22 is defined by a circular washer shaped rim 23 of cup holder member 12. A rectangular logo display area 24, a lid securing hook and pile fastener section 26, and two closeable side pockets 28*a*,28*b* (28*b* shown in FIG. 4) are carried on an exterior sidewall 30 of cup holder member 12. Each closeable side pocket 28*a*,28*b* is provided with a hook and pile closable pair 32*a*,32*b* to seal a top edge 34 of each closeable side pocket 28*a*,28*b* in the closed position.

Lid member 14 is disk shaped and of molded plastic construction. Lid member 14 is pivotally attached to cup holder member 12 with a flexible, woven, nylon hinge strap 36 in a manner to be securable over top receiving cavity opening 22 of cup holder member 12. Lid member 14 also includes a securing tab 38 having a hook and pile section 39 that is securable to lid securing hook and pile fastener section 26 of cup holder 12 and audible open lid alerting mechanism 16.

Figure 2:
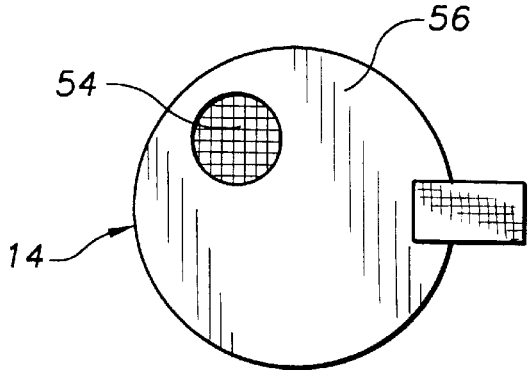
FIG. 2 is a top plan view of the lid member of FIG. 1 in isolation showing the lid member top surface, the securing tab, and the speaker grating of the open lid alerting mechanism.
Figure 3:
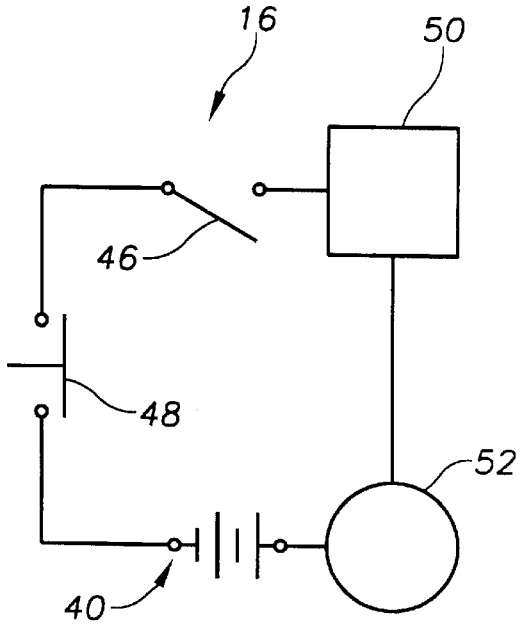
FIG. 3 is a schematic diagram of the audible open lid alerting mechanism showing the interconnections between the battery connector, the two-position on/off switch, the momentary contact activation switch, the alarm signal generating circuit, and the speaker.

Audible open lid alerting mechanism 16 generates an audible alarm output one time for each time lid member 14 is open to alert the owner of coin carrier 10 that lid member 14 is in the open position. Audible open lid alerting mechanism 16 includes a battery connector 40 (FIG. 3) housed within a battery compartment 42 formed into a receiving cavity facing surface 44 of lid member 14; a two-position on/off switch 46, a normally closed momentary contact activation switch 48, an audible signal generating circuit 50 (FIG. 3), and a speaker 52 (FIG. 3) that is, with reference now to FIG. 2, is positioned beneath a speaker grate 54 formed on a lid member top surface 56 of lid member 14. Referring now to FIG. 3, in this embodiment audible signal generating circuit 50 is a conventional oscillator circuit.

With reference back to FIG. 1, activation switch 48 is position adjacent to the perimeter edge 60 of lid member 14 such that, when lid member 14 is secured over and sealing top receiving cavity opening 22, activation switch 48 contacts and is depressed inward by rim 23 of cup holder member 12.

Adjustable length support strap assembly 18 includes left and right, woven nylon, support straps 66,68 each having an end 70 secured to exterior sidewall 30 of cup holder member 12; a slidable neck/shoulder cushion 72 slidably mounted onto left support strap 66; and an adjustment buckle 76 securing left and right support straps 66,68 into a closed loop 80 in combination with cup holder member 12. In use, the head of the user is positioned through closed loop 80 and neck/shoulder cushion 72 positioned onto the neck or shoulder of the wearer.

Figure 4:
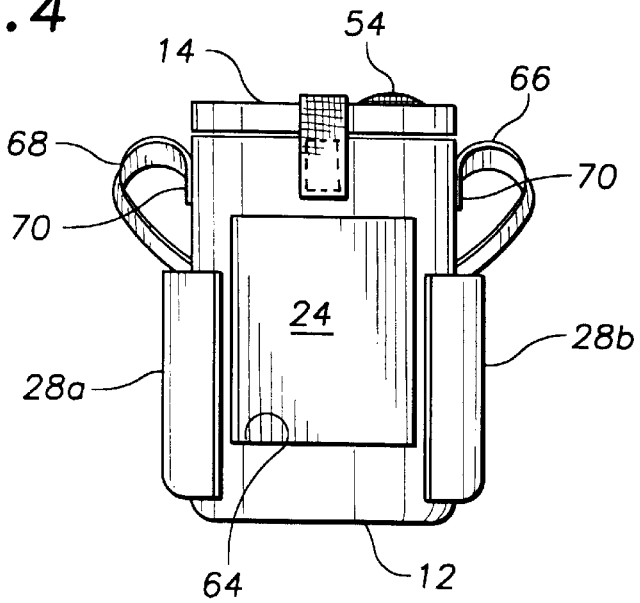
FIG. 4 is a front plan view of the coin carrier of FIG. 1 showing the lid member pivotally positioned over the opening to the cup holding cavity of the cup holder member and secured in place with the securing tab in a manner such that the momentary contact activation switch of the open lid alerting mechanism is depressed.

With reference now to FIG. 4, in this embodiment, rectangular logo display area 24 is defined by a molded perimeter edge 64 and is smooth for receiving a printed, adhesive backed advertising logo label.

It can be seen from the preceding description that a coin carrier has been provided that includes a neck/shoulder support strap that allows a large number of coins to be carried without the necessity of gripping and holding a coin carrying container such as a coin cup with the hands; that has a lid member; that includes a lid having an audible alerting mechanism that generates an audible output each time the lid is opened; and that includes a cup holder member, a lid member including an audible open lid alerting mechanism, and an adjustable length support strap assembly; the cup holder member including a central coin cup receiving cavity formed into the center thereof that is accessible through a top receiving cavity opening, and a logo display area, a lid securing hook and pile fastener section, and at least one closable side pocket carried on an exterior sidewall thereof; the lid member being pivotally attached to the cup holder member with a flexible hinge strap in a manner to be securable over the top receiving cavity opening of the cup holder member; the lid member including a securing tab that is securable to the lid securing hook and pile fastener section of the cup holder member; the audible open lid alerting mechanism including an on/off switch, a battery connector, an activation switch, an audible signal generating circuit, and a speaker; the activation switch being positioned on a receiving cavity facing surface of the lid member at a location such that, when the lid member is positioned over and sealing the top receiving cavity opening, the activation switch is depressed sufficiently to reset the audible signal generating circuit; the adjustable length support strap assembly including left and right support straps each having an end secured to the exterior sidewall of the cup holder member and an adjustment buckle securing the left and right support straps into a closed loop.

It is noted that the embodiment of the coin carrier described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A coin carrier comprising:

a cup holder member;

a lid member including an audible open lid alerting mechanism; and an adjustable length support strap assembly secured to said cup holer member and forming a closed loop in connection with said cup holer member;

said cup holder member including a central coin cup receiving cavity formed into a center thereof that is accessible through a top receiving cavity opened, and a logo display area, a lid securing hook and pile fastener section, and at least one closable side pocket carried on an exterior sidewall thereof;

said lid member being pivotally attached to said cup holder member with a flexible hinge strap in a manner to be securable over said top receiving cavity opening of said cup holder member;

said lid member including a securing tab that is securable to said lid securing hook and pile fastener section of said cup holder member;

said audible open lid alerting mechanism including an on/off switch, a battery connector in electrical connection with said on/off switch, an activation switch in electrical connection with said battery connector, an audible signal generating circuit responsive to an electrical input from said activation switch to generate a speaker drive signal at a speaker drive output thereof, and a speaker in electrical connection with said speaker drive output responsive to said speaker drive signal by generating an audible indicator; said activation switch being positioned on a receiving cavity facing surface of said lid member at a location such that, when said lid member is positioned over and sealing said top receiving cavity opening, said activation switch is depressed sufficiently against a rim of said cup holder member defining said top receiving cavity opening to reset said audible signal generating circuit.

2. The coin carrier of claim 1, wherein:

said adjustable length support strap assembly includes left and right support straps each having an end secured to said exterior sidewall of said cup holder member and an adjustment buckle securing said left and right support straps into said closed loop.

* * * * *